US005509218A

United States Patent [19]

Arcan et al.

[11] Patent Number: 5,509,218

[45] Date of Patent: Apr. 23, 1996

[54] CUSHIONING DEVICES FOR FEET

[76] Inventors: Mircea Arcan, Tagore 42/22, Tel Aviv, Israel; Radu Arcan, 609 Old Country Rd., Elmsford, N.Y. 10523

[21] Appl. No.: 359,312

[22] Filed: Dec. 19, 1994

[51] Int. Cl.[6] ..... A43B 13/38; A43B 13/40; A43B 23/28

[52] U.S. Cl. ..... 36/43; 36/44; 36/59 C; 36/28; 36/174; D2/960

[58] Field of Search ..... 36/25 R, 28, 43, 36/44, 59 R, 59 C, 140–144, 166, 174, 180, 91, 163, 35 R, 80, 3 B; D2/951, 953, 954, 955, 956, 960

[56] References Cited

U.S. PATENT DOCUMENTS

| | | | |
|---|---|---|---|
| 901,236 | 10/1908 | Gordon | 36/3 B |
| 2,088,707 | 8/1937 | King | 36/44 X |
| 4,546,556 | 10/1985 | Stubblefield | 36/29 X |
| 4,793,078 | 12/1988 | Andrews | 36/43 |
| 4,879,821 | 11/1989 | Graham et al. | 36/44 |
| 5,079,856 | 1/1992 | Truelsen | 36/25 R |

FOREIGN PATENT DOCUMENTS

| | | | |
|---|---|---|---|
| 0270448 | 11/1966 | Austria | 36/59 C |
| 1147145 | 5/1983 | Canada | 36/25 R |
| 2610485 | 8/1988 | France | 36/43 |
| 1750639 | 7/1992 | U.S.S.R. | 36/44 |

*Primary Examiner*—Paul T. Sewell
*Assistant Examiner*—Ted Kavanaugh
*Attorney, Agent, or Firm*—Mark M. Friedman

[57] ABSTRACT

A cushioning device for cushioning the contact load on a foot during gait. The cushioning device includes a tread of curvilinear shock absorbing elements substantially extending along a basic contact trajectory equivalent to the locus of substantially maximum contact stress during foot rolling. Each shock absorbing element has a triangular-shaped cross section having an inclined face oriented toward the contact trajectory such that each of the shock absorbing elements is flexed away from the basic contact trajectory during stance. As a result, the cushioning device deforms along the basic contact trajectory to a greater degree than on the rest of the device area, thereby equalizing the plantar contact stresses and improving the shock absorbing process.

12 Claims, 8 Drawing Sheets

CUSHIONING DEVICES FOR FEET

FIELD AND BACKGROUND OF THE INVENTION

The present invention relates to cushioning devices in general and in particular to cushioning devices for feet. Hence, the present invention relates to cushioning devices implemented as insoles or as soles of shoes.

It is well known that human beings are continually exposed to dynamic loading environments while walking, working, and the like which may be related to physiological disturbances including, for example, stress fractures, low back pain, tissue degradation, and the like.

Considerable efforts have been expended to develop different materials and structures for shoes in general and soles and insoles in particular. However, it is true to say that most shoes do not provide the comfort in terms of fit and cushioning demanded by the general public as evidenced by the widespread use of insoles.

At the same time, it is also well known that today insoles do not cushion feet during gait to a significant degree. In fact, the often elaborate designs of so-called orthopaedic insoles have little biomechanical support, if any, to function as a foot's natural complement. Furthermore, there is no scientific support for the structure of presently available insoles in terms of the foot rolling process.

There is therefore a need for cushioning devices which cushion feet during gait which are based on the principle of relating the cushioning device with the load transfer process during foot rolling.

SUMMARY OF THE INVENTION

The present invention is for a cushioning device for cushioning the contact load on a foot during gait or standing.

Hence, there is provided according to the present invention, a cushioning device for cushioning a foot during gait, the device comprising a tread of curvilinear shock absorbing elements substantially extending along a basic contact trajectory equivalent to the locus of substantially maximum contact stress during foot rolling.

According to a further feature of the present invention, the shock absorbing elements substantially extend along isobaric lines or equal contact stress lines.

According to a still further feature of the present invention, each of the shock absorbing elements has a wedge-shaped cross section having an inclined face oriented toward the basic contact trajectory such that each of the shock absorbing elements is flexed away from the basic trajectory during foot rolling.

According to a yet still further feature of the present invention, a pair of the shock absorbing elements have symmetrically inclined faces relative to the basic contact trajectory such that the pair of shock absorbing elements is symmetrically flexed away from the basic trajectory during foot rolling inducing maximal deformations along the basic contact trajectory and substantially equalizing the contact pressure pattern.

According to a yet still further feature of the present invention, each of the shock absorbing elements has a substantially triangular wedge-shaped cross section including a substantially upright face oriented at an angle of about 90° or greater relative to a horizontal plane passing through the basic contact trajectory.

According to a yet still further feature of the present invention, the device further comprises a foot contact surface having a raised area located under the lateral side of the mid-foot for supporting the arch of the foot.

According to a yet still further feature of the present invention, the device further comprises a foot contact surface having a depression for receiving the metatarsal heads of the foot for enlarging the local contact area.

According to a yet still further feature of the present invention, the device further comprises a metatarsal head pad for transferring the contact stresses during the push-off phase of stance to the tread of shock absorbing elements.

According to a yet still further feature of the present invention, the device further comprises a foot contact surface having a depression for receiving the heel of the foot for enlarging the local contact area, the depression being located in a substantially thickened portion of the device.

According to a yet still further feature of the present invention, the device further comprises a heel pad for transferring the contact stresses during heel-strike to the tread of shock absorbing elements.

According to a yet still further feature of the present invention, the device further comprises a protective layer for the tread of shock absorbing elements.

According to a yet still further feature of the present invention, the protective layer includes a slack portion enabling displacement of the protective layer relative to the tread.

According to a yet still further feature of the present invention, the device realized as an insole.

According to a yet still further feature of the present invention, the device realized as the sole of a shoe.

There is also provided according to the teachings of the present invention, a cushioning device for cushioning a foot during a standing posture, the device comprising a tread of curvilinear shock absorbing elements substantially extending along a basic contact trajectory equivalent to the locus of substantially maximum contact stress during standing.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a cushioning device for cushioning a foot during gait or foot rolling and is also of a cushioning device for cushioning a foot during a standing posture.

The principles and operation of the cushioning devices according to the present invention may be better understood with reference to the drawings and the accompanying description.

Figure 1A:
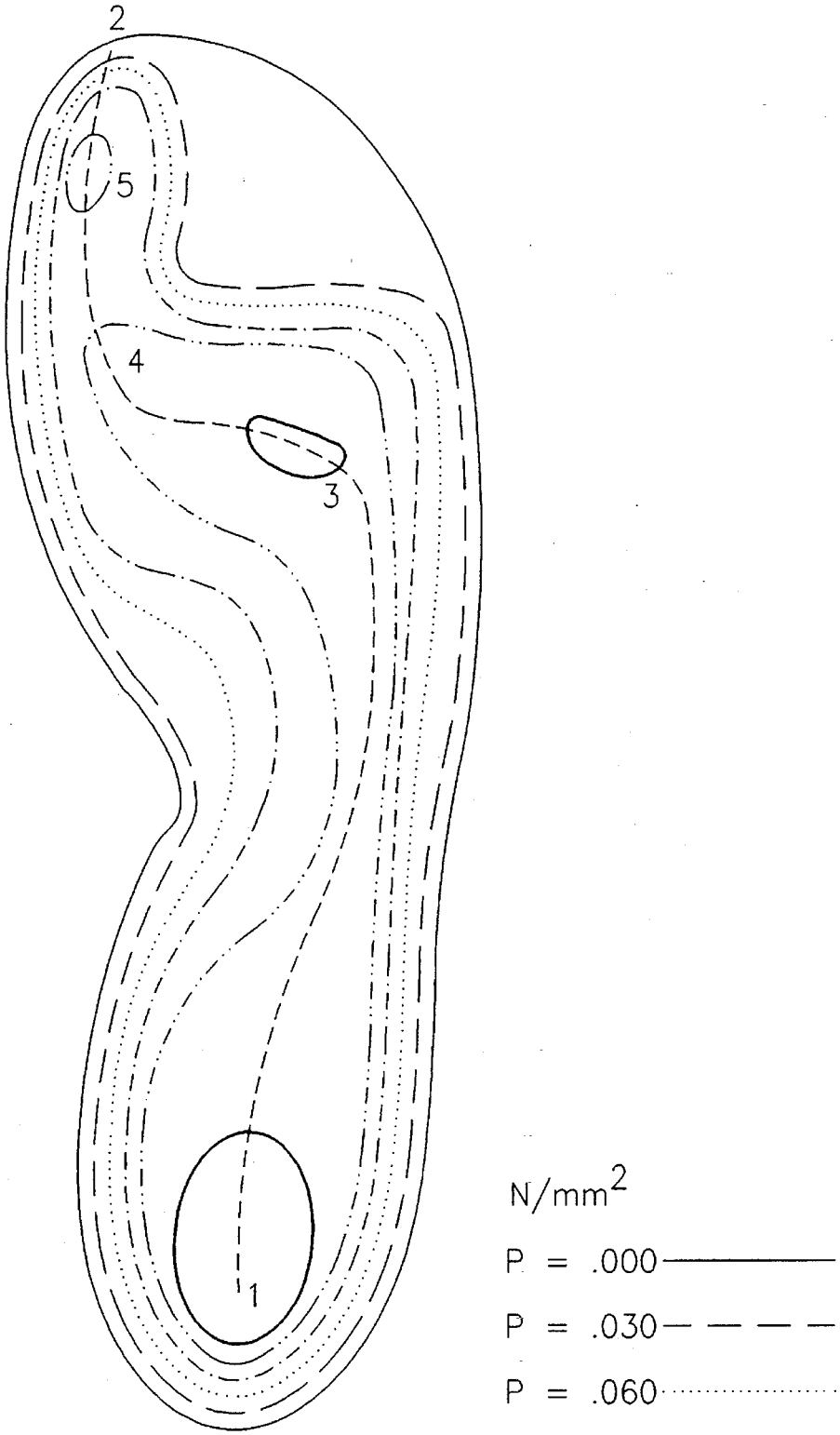
FIG. 1*a* illustrates a fight foot isobar map of equal contact stress lines during gait or a foot rolling. See FIG. 2 which shows the longitudinal axis of the cushioning device running from the heel portion (first end-portion) to the toe portion (second opposite end-portion), which corresponds with the longitudinal axis of the foot process.
Figure 1B:
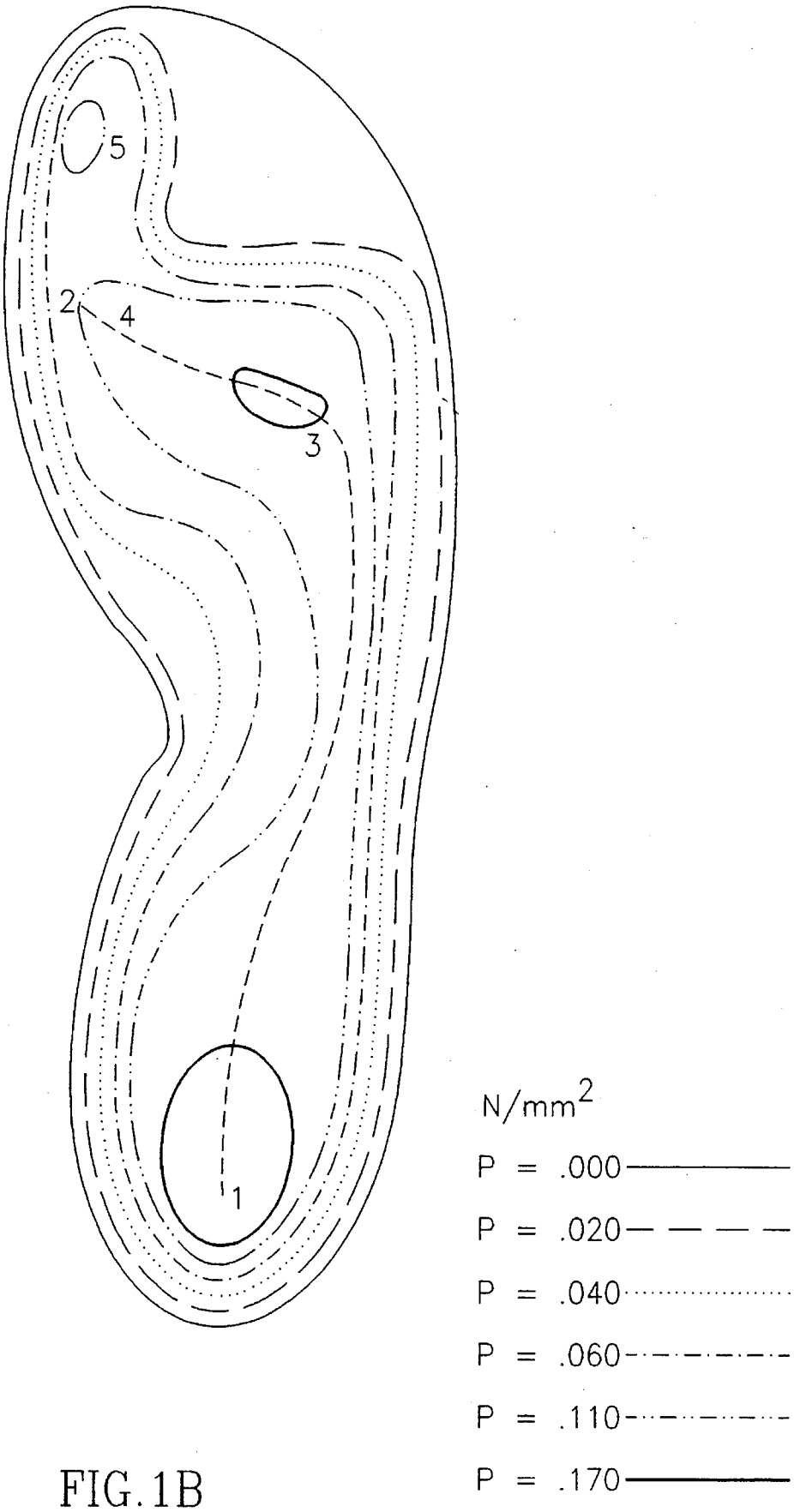
FIG. 1*b* illustrates a fight foot isobar map of equal contact stress lines during standing posture.
Figure 2:
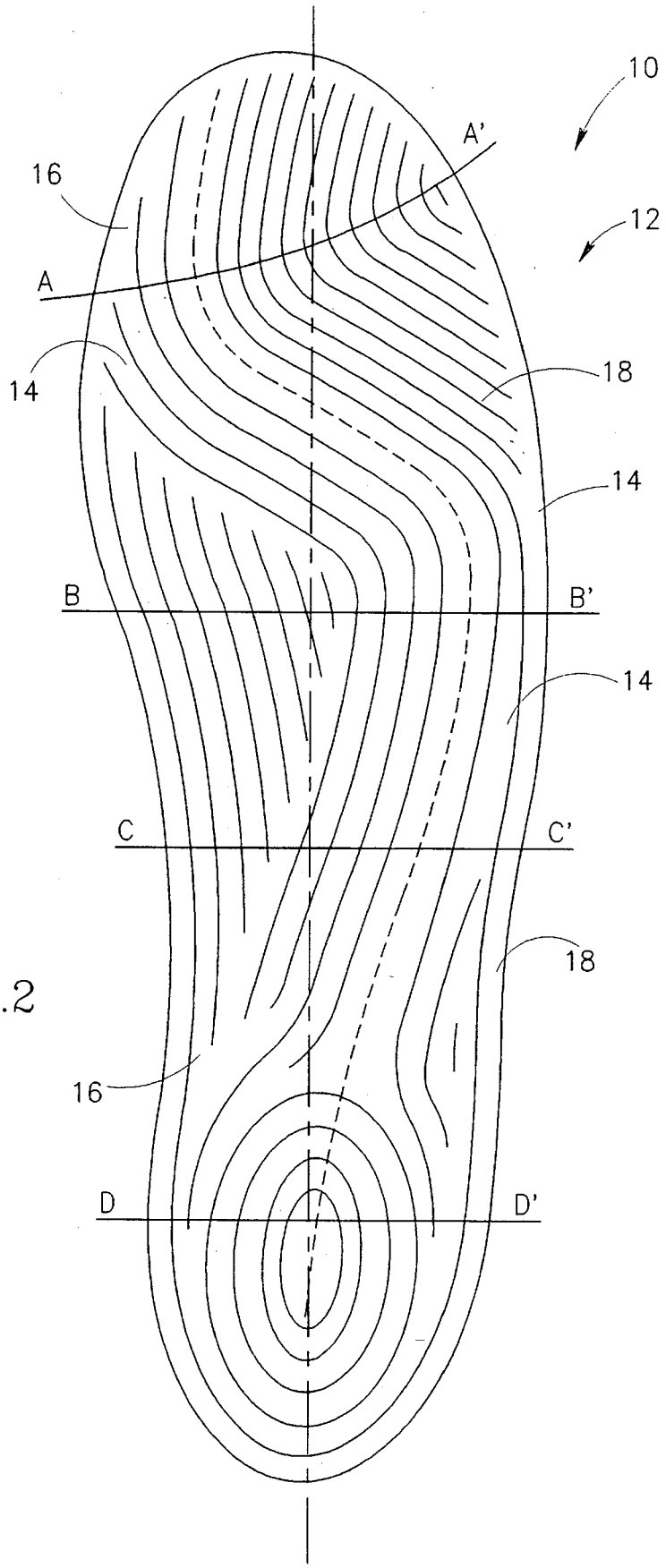
FIG. 2 illustrates a bottom planar view of a cushioning device, constructed and operative according to the teachings of the present invention, for cushioning the contact load on a fight foot during foot rolling (from heel strike to toe off)

For better understanding the bio-mechanical engineering principles underlying the cushioning devices of the present invention, reference is now made to exemplary maps of equal contact stress lines (isobars) for a right foot illustrated in FIGS. 1*a* and 1*b*.

Turning now to FIG. 1*a*, the map depicts six isobars, selected as p=0.00 N/mm$^2$, p=0.030 N/mm$^2$, p=0.060 N/mm$^2$, p=0.090 N/mm$^2$, p=0.215 N/mm$^2$ and p=0.340 N/mm$^2$, representing a foot rolling process from a heel strike position of the foot to a toe-off position of the foot. The map further depicts the locus of substantially maximum contact stress of the right foot during foot rolling as a heavy dashed line. The locus of substantially maximum contact stress during a foot rolling process is hereinafter referred to as the "basic contact trajectory". It should be noted that the basic contact trajectory which represents the foot rolling contact is not the same as the locus of the center of pressure, used in the literature, which represents the reaction force progression passing through points not even on the contact area.

The basic contact trajectory has a heel strike start 1 and a toe-off end 2 and can be regarded as having a rear portion 1–3 and a front portion 3–4. Rear portion 1–3 corresponds to the fast advancing foot rolling process of the foot along the lateral side of the arch, part of which may be missing in the case of a high arch. Front portion 3–4 corresponds to the slow advancing foot rolling process of the foot along the so-called metatarsal break. The basic contact trajectory 1–2 extends finally through the base of big toe 5 toward toe-off end 2, corresponding to the toe-off phase of the foot rolling process. An important geometrical characteristic of basic contact trajectory 1–2 is its acute change of direction of about 60°, with about +5° deviation, at front portion 3–4 relative to the longitudinal axis of the foot.

Turning now to FIG. 1*b*, it can be readily seen that the map of equal contact stress lines during a standing posture is similar to the map during foot rolling. The major difference therebetween being that the basic contact trajectory which in this case is limited to the metatarsal area.

With reference now to FIGS. 2–7, there is shown a cushioning device, generally designated 10, constructed and operative according to the teachings of the present invention, for cushioning a foot during foot rolling. See FIG. 2 which shows the longitudinal axis of the cushioning device running from the heel portion (first end-portion) to the toe portion (second opposite end-portion), which corresponds with the longitudinal axis of the foot. As will become apparent hereinbelow, cushioning device 10 can be realized as a disposable insole or, alternatively, as the sole of a shoe. In both cases, cushioning device 10 is fabricated from a rubber-like material, for example, polyurethane, and the like. In particular, selection of the material in terms of its stiffness is such that consideration is given to subject's weight, the intended application, as sole or insole, and the like. Furthermore, in the case that cushioning device 10 is realized as a disposable insole, it can be fabricated from odor eating materials as known in the art.

Referring now to FIGS. 2–5, it is a particular feature of cushioning device 10 that its tread 12 includes curvilinear cushioning elements 14 or shock absorbing elements 14 substantially extending along the basic contact trajectory 1–2 such that they facilitate the energy dissipation of the impact load of the foot as the foot passes through a heel strike to toe off cycle. The energy dissipation is achieved through the deformation of cushioning elements 14 configured as elongated wedge shaped projections having their inclined faces oriented toward the basic contact trajectory 1–2. Wedge-shaped cushioning elements 14 have a substantially triangular shaped cross section having an angle of about 90° or greater adjacent to the horizontal plane of insole 10. Typically, wedge-shaped cushioning elements 14 have base lengths denoted b of between 2 mm and 6 mm and an upright height denoted h of between 2 mm and 6 mm.

Figure 3:
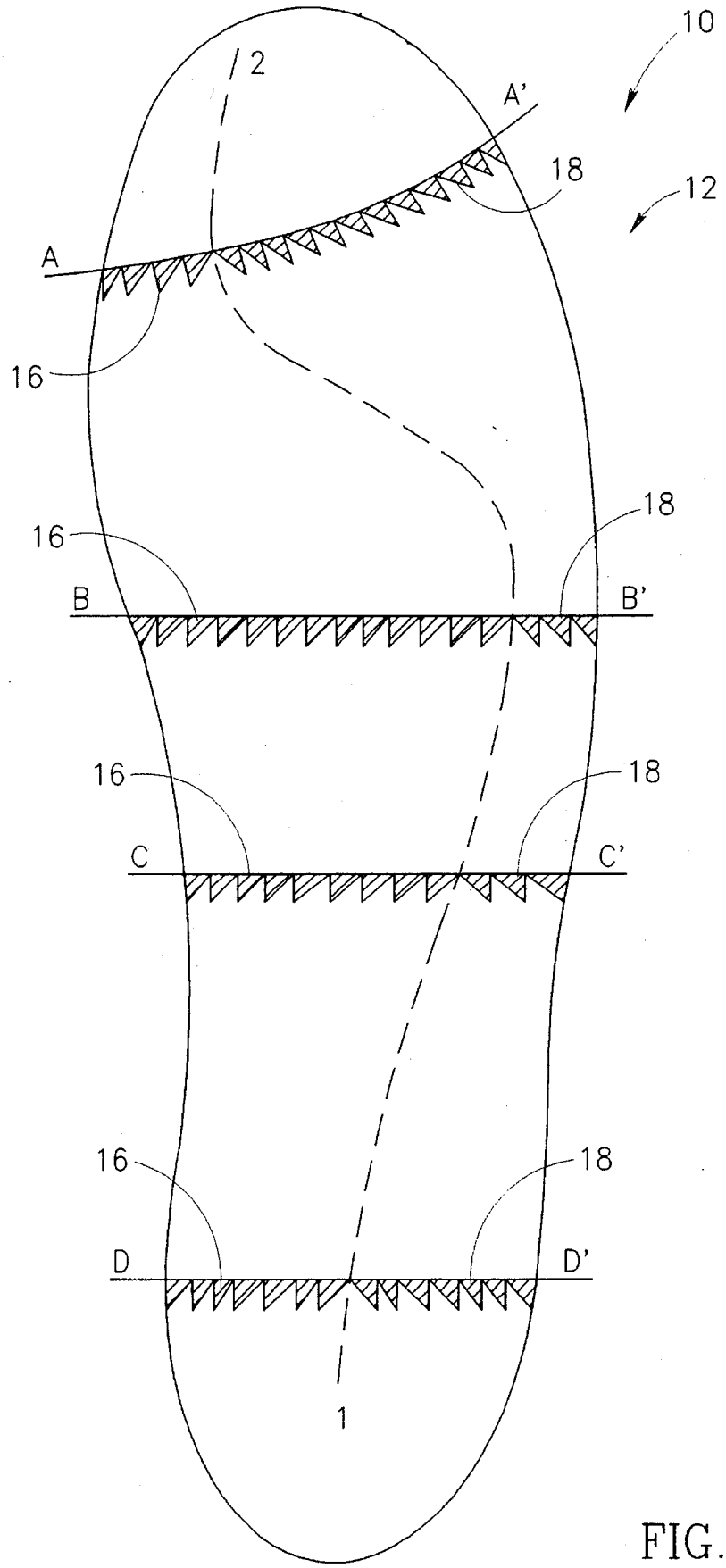
FIG. 3 illustrates a schematic cross sectional view of the cushioning device along lines A—A', B—B', C—C', and D—D' on FIG. 2 with the basic contact trajectory denoted 1–2.
Figure 4A:
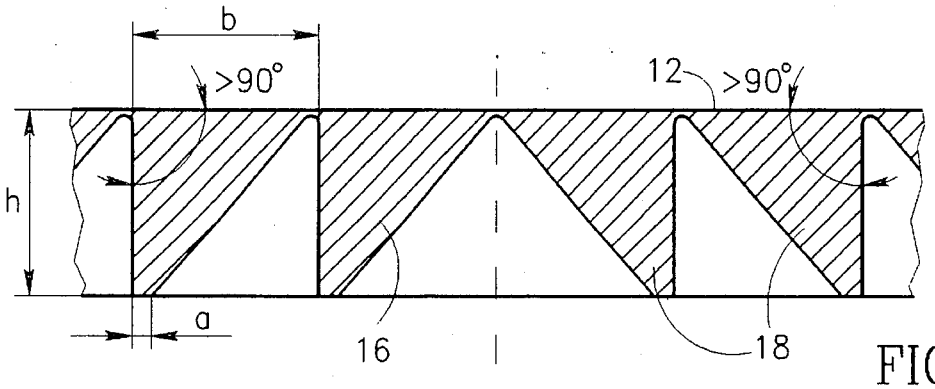
FIGS. 4*a* and 4*b* illustrate a cross sectional view of the cushioning elements of the cushioning device before loading and during loading, respectively.
Figure 4B:
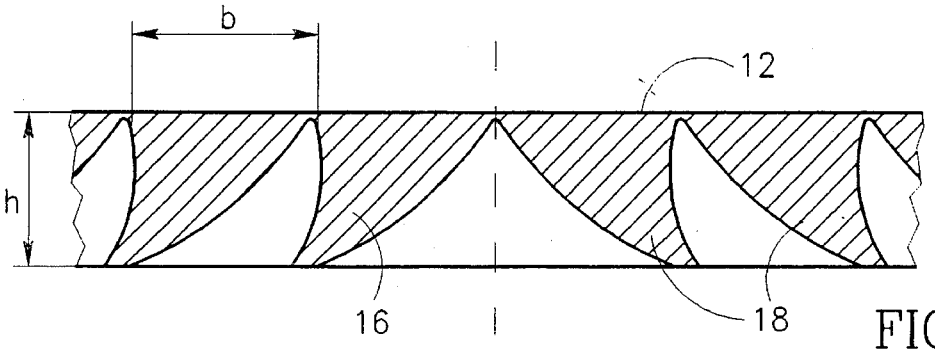

As can be readily understood with reference to FIGS. 3, 4*a* and 4*b*, the deformation of cushioning elements 14 is such that they are flexed away from the basic contact trajectory 1–2 along their lengths as load is gradually transferred during a heel strike to toe off cycle. Hence, cushioning elements 14 can be differentiated as cushioning elements 16 flexed medially from the basic contact trajectory 1–2 and cushioning elements 18 flexed laterally from the same contact trajectory 1–2.

As the above described cushioning elements 14 are symmetrically flexed away from the basic contact trajectory 1–2, the device deforms along the basic contact trajectory to a greater degree than on the rest of the device area, thereby equalizing the plantar contact stresses and improving the shock absorbing process.

Figure 5A:
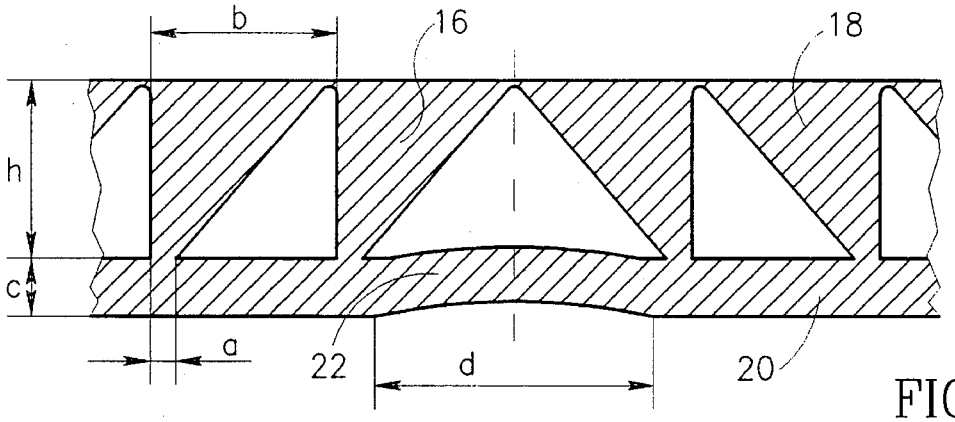
FIGS. 5*a* and 5*b* illustrate a cross sectional view of a cushioning device having a protective layer for the cushioning elements before loading and during loading, respectively.
Figure 5B:
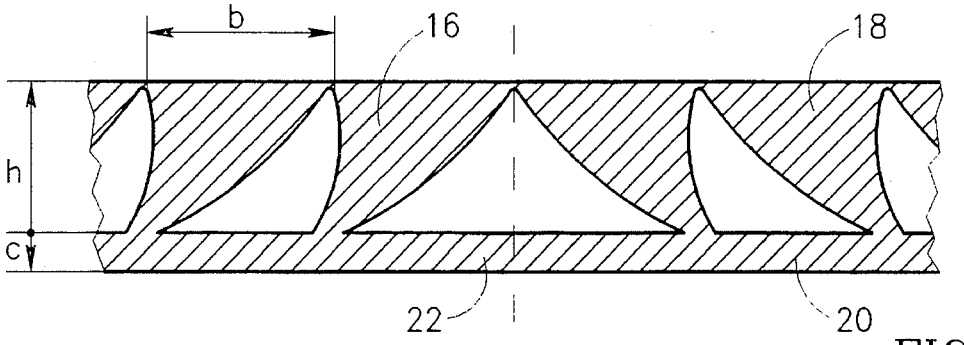

Turning now to FIGS. 5*a* and 5*b*, cushioning elements 14 can be protected by a protective layer 20 which is deployed under tread 12. In effect, protective layer 20 is attached to the bottom rims of cushioning elements 14. Protective layer 20 preferably includes a slack portion 22 deployed under the basic contact trajectory 1–2 for enabling the displacement of the portion of protective layer 20 under cushioning elements 16 toward the left as cushioning elements 16 are flexed medially of contact trajectory 1–2 and the displacement of the portion of protective layer 20 under cushioning elements 18 toward the fight as cushioning elements 18 are flexed laterally of contact trajectory 1–2.

Figure 6:
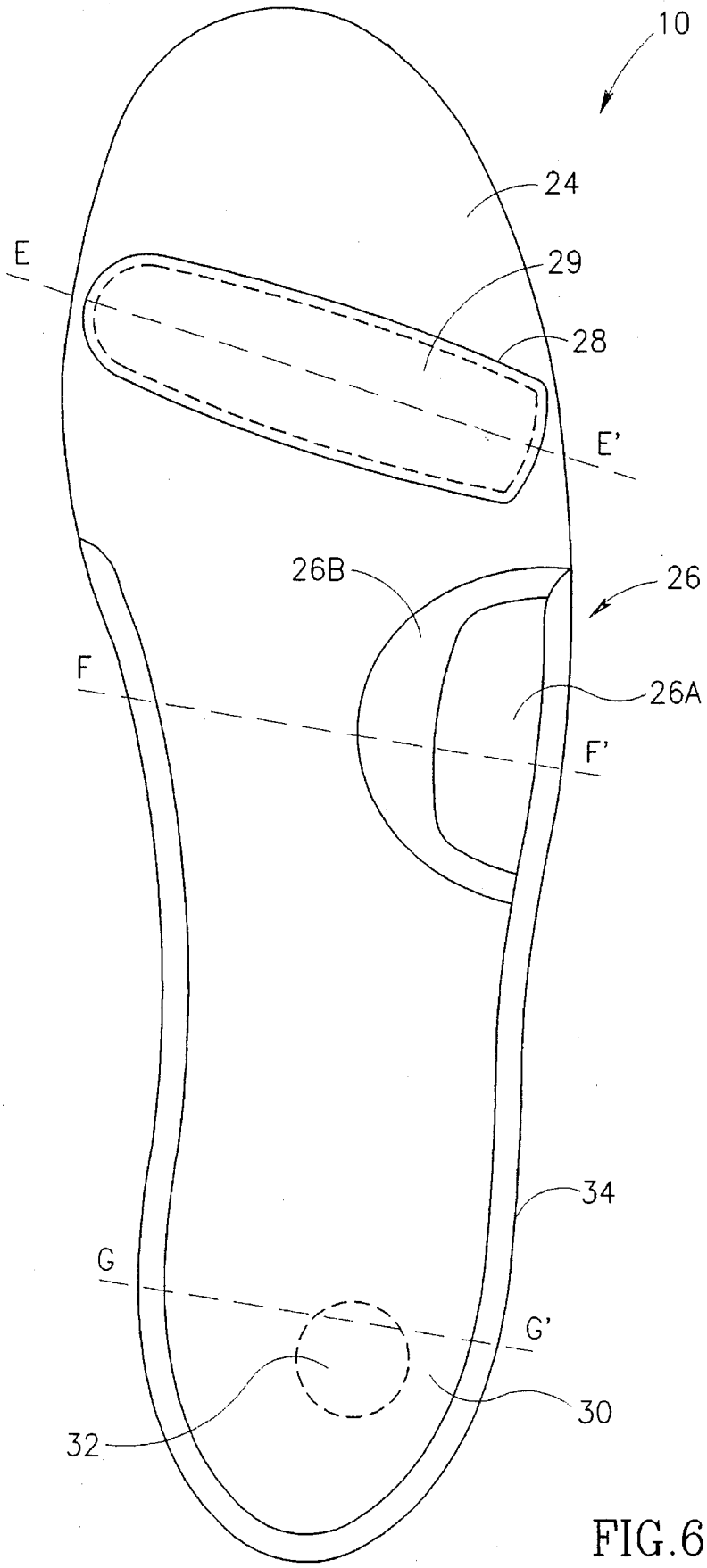
FIG. 6 illustrates a top planar view of the cushioning device.
Figure 7:
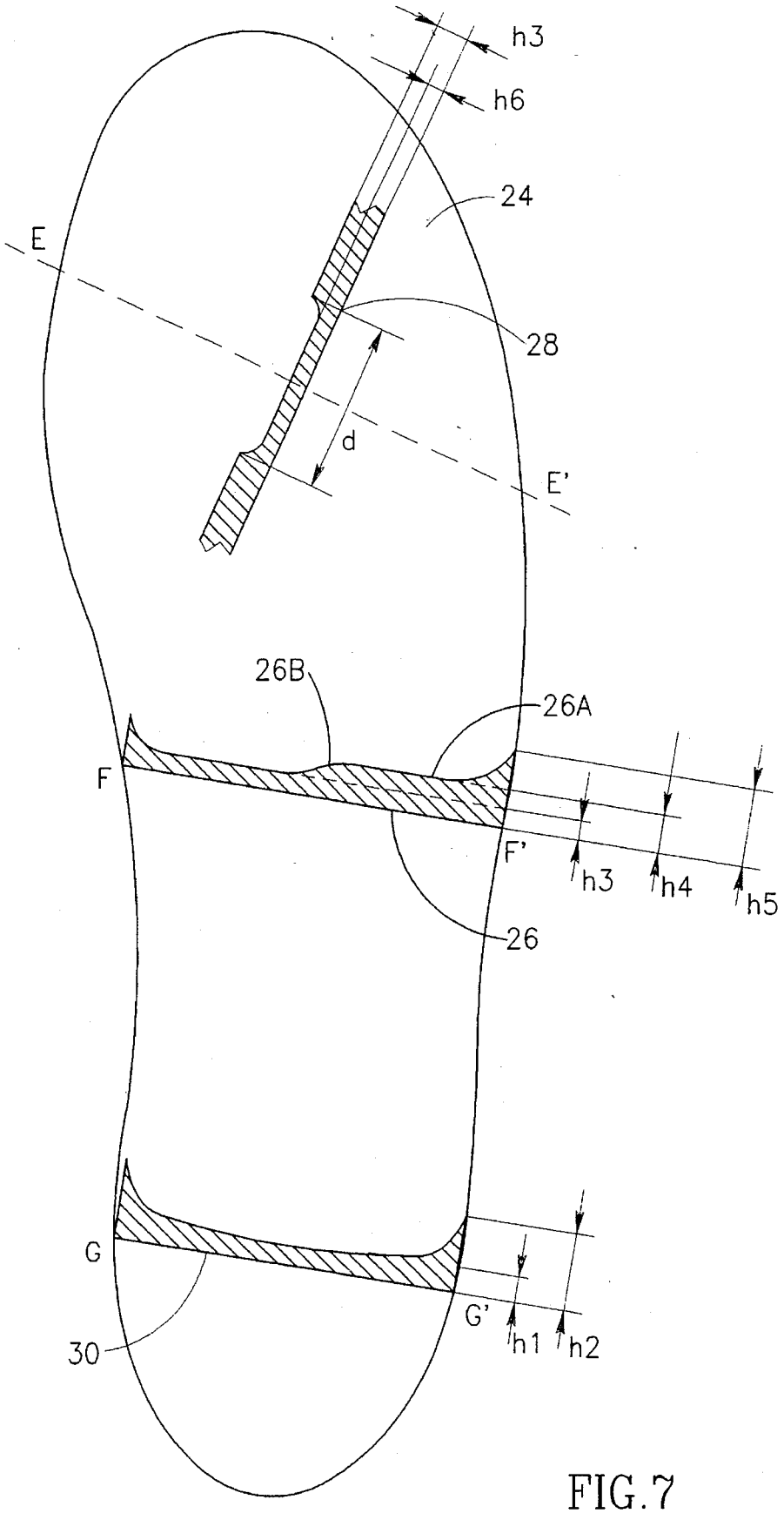
FIG. 7 illustrates cross sectional views of the cushioning device along lines E—E', F—F' and G—G' on FIG. 6.

Turning now to FIGS. 6 and 7, it is a further feature of cushioning device 10 that its foot contact or anatomic surface 24 can be provided with support features to provide localized arch support or as a fiat surface enabling an orthopaedic professional to introduce local support regions for particular medical conditions. Typical well known abnormal medical conditions include, but are not limited to, very high arch, flat foot, metatarsal head deformations, and the like. In all cases, the actual foot contact or anatomic surface 24 required can be determined by analysis of the footground contact stress map of a user, the basic contact trajectory of a user, and the like.

This is achieved by providing foot contact surface 24 with four features. First, a raised area 26 located under the lateral side of the mid-foot for supporting the arch of the foot. Second, a depression 28 for receiving the metatarsal heads of the foot overlying a thin metatarsal pad 29. Third, a depression 30 for supporting the heel of the foot overlying a heel pad 32 implanted in the relatively thickened rear portion of cushioning device 10. And fourth, a contoured U-shaped support 34 extending from one side of the mid-foot to the other side of the mid-foot around the heel of the foot to improve the stability of the foot in the shoe.

Although the actual design of elements 26, 28, 29, 30, 32 and 34 can be dedicated to some special groups of foot structure as described hereinabove, the elements 26, 28, 29, 30, 32 and 34 conform to some basic bio-mechanical principles as follows: Arch support 26 is deployed along the basic contact trajectory 1–2 in contrast to conventional insoles or shoes which deploy arch supports under the medial side of the mid-foot, thereby transferring the load in a manner not fit-ting to the anatomical/biomechanical structure of the foot. Arch support 26 has a higher plateau 26*a* and a portion 26*b* inclined downward and tapered toward the fore-foot and mid-foot regions of foot contact surface 24. Depressions 28 and 30 are also preferably tapered so as to enlarge the contact areas of the metatarsal heads and of the heel, respectively, thereby reducing the contact stresses. Pads 29 and 32 are preferably fabricated from rubber-like material having greater stiffness than the rest of cushioning device 10 so as to transfer the contact stress during heel-strike or push-off phases to tread 12.

Figure 8:
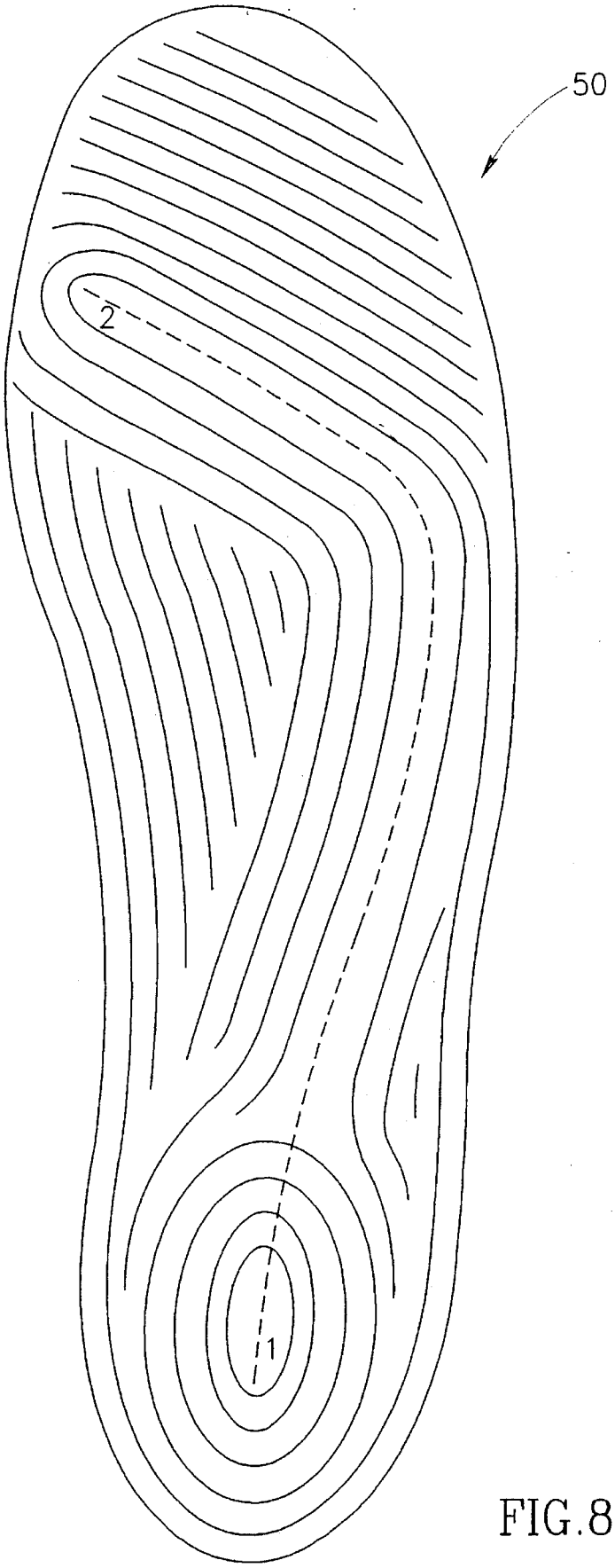
FIG. 8 illustrates a bottom planar view of a cushioning device, constructed and operative according to the teachings of the present invention, for cushioning the contact load on a right foot during standing posture.

With reference now to FIG. 8, there is shown a cushioning device, generally designated 50, constructed and operative according to the teachings of the present invention, for cushioning a foot during a standing posture. Such a device is useful for people working most of the day in a standing posture. Cushioning device 50 is similar to cushioning device 10 and therefore similar elements are likewise numbered. The major difference between cushioning device 50 and cushioning device 10 is due to the basic contact trajectory not extending through the big toe as described hereinabove with reference to the isobar map of FIG. 1*b*.

While the invention has been described with respect to a limited number of embodiments, it will be appreciated that many variations, modifications and other applications of the invention may be made.

What is claimed is:

1. A cushioning device for cushioning a foot during gait, the device comprising:

a plurality of shock absorbing rings, said plurality of shock absorbing rings located around a common center-line and positioned to lie under and support the heel of a foot in a first end-portion of the cushioning device; and a plurality of shock absorbing rows, said plurality of shock absorbing rows lying parallel to each other and following the contour of a maximum contact stress path, said maximum contact stress path extending from said plurality of shock absorbing rings to just prior a metatarsal break along an axis forming a small acute angle lateral from a longitudinal axis of the cushioning device, and continuing through the metatarsal break along an axis approximately 60 degrees medial from the longitudinal axis of the cushioning device and continuing through a second opposite end portion of the cushioning device along an axis parallel to the longitudinal axis of cushioning device, said maximum contact stress path corresponding to a path of maximum pressure developed by the foot as it is rolled from a heel strike position to a toe off position.

2. The device as in claim 1 wherein said shock absorbing rings include an inclined surface and a surface at least 90 degrees from the horizontal, said inclined surface oriented towards the center of said plurality of shock absorbing rings.

3. The device as in claim 1 wherein said shock absorbing rows includes medial wedge shaped shock absorbing rows and lateral wedge shaped shock absorbing rows substantially symmetrically inclined around said maximum contact stress path.

4. The device of claim wherein said wedge shaped medial shock absorbing rows lie medially to said maximum contact stress path, said medial wedge shaped shock absorbing rows include an inclined surface and a surface at least 90 degrees from the horizontal, said inclined surface oriented laterally toward said maximum contact stress path.

5. The device as in claim wherein said lateral wedge shaped shock absorbing rows lie laterally to said maximum contact stress path, said lateral wedge shaped shock absorbing rows include an inclined surface and a surface at least 90 degrees from the horizontal, said inclined surface oriented medially toward said maximum contact stress path.

6. The device as in claim 1 further comprising a midfoot contact surface having a raised portion located along said maximum contact stress path for supporting the arch of the foot.

7. The device as in claim 1 further comprising a metatarsal head pad having a depression for receiving the metatarsal heads of the foot.

8. The device as in claim 1 further comprising a heel pad having a depression for receiving the heel of the foot.

9. The device as in claim 1 further comprising a protective layer for said plurality of concentric shock absorbing rings and said plurality of shock absorbing rows.

10. The device as in claim 9 wherein said protective layer includes a slack portion enabling displacement of said protective layer relative to said plurality of concentric shock absorbing rings and said plurality of shock absorbing rows.

11. The device as in claim 1 wherein said plurality of concentric shock absorbing rings and plurality of shock absorbing rows are constructed as an insole positioned between the foot and a sole of a shoe.

12. The device as in claim 1 wherein said plurality of concentric shock absorbing rings and said plurality of shock absorbing rows are constructed as a sole of a shoe positioned below an insole of a shoe.

* * * * *

UNITED STATES PATENT AND TRADEMARK OFFICE

CERTIFICATE OF CORRECTION

PATENT NO. : 5,509,218

DATED : April 23, 1996

INVENTOR(S) : Mircea Arcan et al

It is certified that error appears in the above-indentified patent and that said Letters Patent is hereby corrected as shown below:

Column 6, line 23, replace "claim" with --claim 3--

Column 6, line 28, replace "claim" with --claim 3--

Signed and Sealed this

Tenth Day of September, 1996

*Attest:*

*Attesting Officer*

BRUCE LEHMAN

*Commissioner of Patents and Trademarks*